United States Patent [19]

Cosmo

[11] Patent Number: 4,477,133

[45] Date of Patent: Oct. 16, 1984

[54] MINIATURE CAM DRIVEN CONNECTOR FOR A CIRCUIT BOARD EDGE

[75] Inventor: Nicola Cosmo, Harrisburg, Pa.

[73] Assignee: AMP Incorporated, Harrisburg, Pa.

[21] Appl. No.: 410,291

[22] Filed: Aug. 23, 1982

[51] Int. Cl.[3] ..... H01R 9/09

[52] U.S. Cl. ..... 339/17 M; 339/75 MP; 339/176 MP

[58] Field of Search ..... 339/17 M, 74 R, 75 MP, 339/176 MP

[56] References Cited

U.S. PATENT DOCUMENTS

| | | | |
|---|---|---|---|
| 3,920,302 | 11/1975 | Cutchaw | 339/75 MP |
| 4,077,688 | 3/1978 | Cobaugh et al. | 339/74 |
| 4,159,154 | 6/1979 | Arnold | 339/75 MP |
| 4,268,102 | 5/1981 | Grabbe | 339/75 M |
| 4,386,815 | 6/1983 | Carter et al. | 339/17 M |
| 4,392,700 | 7/1983 | Showman et al. | 339/17 M |

FOREIGN PATENT DOCUMENTS

| | | | |
|---|---|---|---|
| 2423266 | 12/1974 | Fed. Rep. of Germany | 339/75 MP |
| 2252670 | 6/1975 | France | 339/75 MP |
| 1187949 | 4/1970 | United Kingdom | 339/176 MP |

*Primary Examiner*—John McQuade

*Attorney, Agent, or Firm*—Donald M. Boles

[57] ABSTRACT

A miniature circuit board edge connector having a very short electrical contact path is taught. Briefly stated, an insulative housing has contained therein a resiliently flexible contact holder which has electrically conductive contacts pivotally attached thereto. A camming device is disposed on top of the contact holder so as to cause resilient flexing of the contact holder. Flexing of the contact holder causes the contacts to pivot downward and outward from the contact holder and thereby come in contact with an electrically conductive path on a daughter board which is adjacent thereto and also with a conductive post which is mounted in the base of the connector assembly and attached to a mother board. The electrical path between the daughter board circuit path and the mother board conductive posts through the contact is very short and in a slightly arcuate manner which minimizes inductive, capacitive and propagation delay effects which may come about.

18 Claims, 8 Drawing Figures

CLOSED

OPEN

MINIATURE CAM DRIVEN CONNECTOR FOR A CIRCUIT BOARD EDGE

This invention relates, generally, to a circuit board edge connector assembly and more particularly to a zero insertion force connector assembly suitable for singular and multiple circuit boards.

While zero insertion force connectors are relatively common, they generally have a tendency to utilize complex arrangements and complicated manufacturing procedures to accomplish such a purpose. Additionally, contact length between mother and daughter board has a tendency to become unnecessarily long thereby inducing inductive, capacitive, as well as physical delay or propagation time problems into a circuit. These problems are particularly acute where high speed and lower voltage are present. A number of schemes, such as may be found in U.S. Pat. No. 4,077,688 "Zero Force Connector For Circuit Boards" issued on Mar. 7, 1978 to Cobaugh et al, and U.S. Pat. No. 4,268,102 "Low Impedance Electrical Connecting Means For Spaced-Apart Conductors" issued May 19, 1981 to Grabbe, both patents of which are assigned to the same assignee as the present invention, have been utilized to overcome these problems. These mentioned patents utilize electrical contacts which are flexed resiliently by a cam toward and away from electrical circuit conductors on a circuit board edge or utilize a conductor in conjunction with a spring loop to bridge between a post portion and a circuit conductor on an edge of a circuit board. This thereby provides a circuit path with clamping pressure applied to urge the circuit board against the contact so as to cause resilient flexure of the spring loop.

In the present invention, however, an edge of a circuit board is seated on a ledge of an insulative connector housing. The electrical contacts are cammed so as to permit seating or unseating of a circuit board without producing undue exertion of the circuit board against the contacts. The assembly of the present invention incorporates electrical contacts having very short contact lengths and utilizes a cam which through linear motion, resiliently flexes the contacts towards and against circuit conductors on the edge of the main board and the mother board thereby establishing electrical contact therebetween.

It is therefore an object of this invention to provide a zero force insertion and withdrawal connector for a circuit board, having small dimensions, and a very short electrical contact path between the daughter circuit board and the mother circuit board.

It is another object of the present invention to provide a connector assembly which is relatively simple to manufacture and assemble having a minimum number of individual parts or components.

It is still another object of the present invention to provide a connector assembly which in conjunction with utilizing a very short circuit path provides a contact wiping action each and every time a mother circuit board is connected to a main board.

Accordingly, the present invention teaches and as an object of the present invention, a circuit board edge connector having insulative housing, a conductive post projecting from the housing, a circuit board having circuit conductors contained therein with the circuit board being receivably received by the housing, a first spring contact being electrically conductive and adapted for providing electrical communication between corresponding circuit conductors on a circuit board, and the conductive post, a second spring contact pivotally attached to the first spring contact and adapted for resilient flexure so as to move the conductive spring contacts into or out of electrical communication with the conductive post and the circuit conductor, and a cam adjacent to the spring contact for resiliently flexing the second spring contact.

BRIEF DESCRIPTION OF THE DRAWINGS

Reference is now made to the description of the preferred embodiment illustrated in the accompanying drawings in which.

DESCRIPTION OF THE PREFERRED EMBODIMENT

Figure 1:
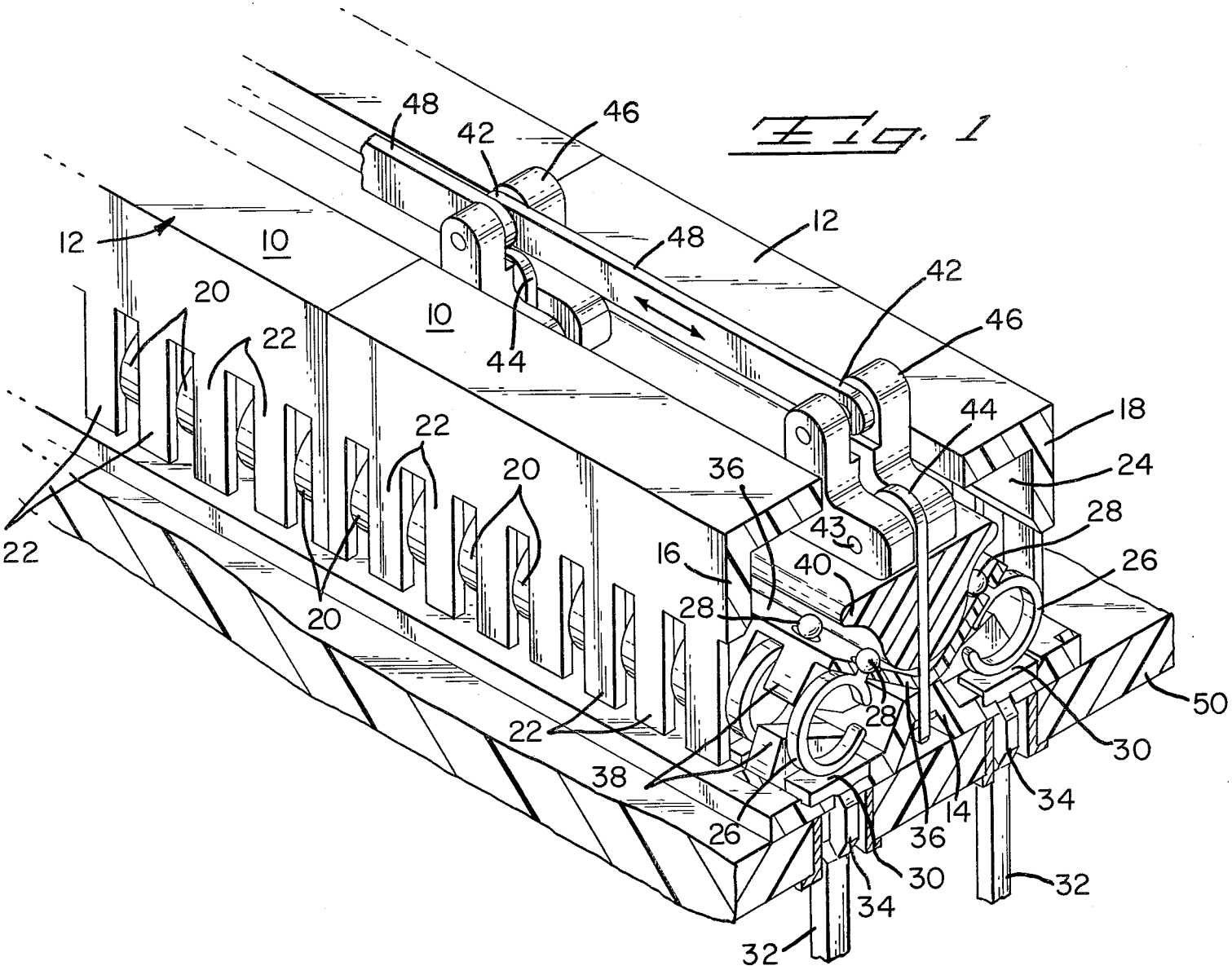
FIG. 1 is an enlarged perspective view of multiple electrical connector assemblies for circuit conductors on either side of a circuit board edge.

Referring now to FIG. 1 there is shown an enlarged perspective view of the connector assembly of the present invention. The connector assembly 10 comprises a housing 12 which is made up of an insulative material such as, for example, plastic and has a bottom and side walls 14, 16 and 18, respectively. Disposed in the housing 12 are contact compartments 20 which house individual contacts 26. The contact compartments 20 are separated by contact compartment barriers 22. The bottom and side walls 14, 16 and 18 of the housing 12, define a passageway 24 suitable for placement of compartments in the connector assembly 10. It should be noted that portions of a second connector assembly 10 are shown for the purpose of illustrating the modularity of the present invention, references to a single connector assembly 10 are used for simplicity purposes only.

The contacts 26, in the preferred embodiment of the present invention, are comprised of a conductive metal and exhibit resiliency so as to be capable of flexure when coming in contact with the electrical post contact 30 or a daughter board (not shown). The contacts 26 have a test point 28 which may be utilized for monitoring and/or trouble shooting associated circuitry (not shown) or the connector assembly 10 itself. Contained in the passageway 24 and disposed between each of the contacts 26 are ribs 38 which provide structural integrity as well as electrical isolation between the contacts 26.

Figure 2:
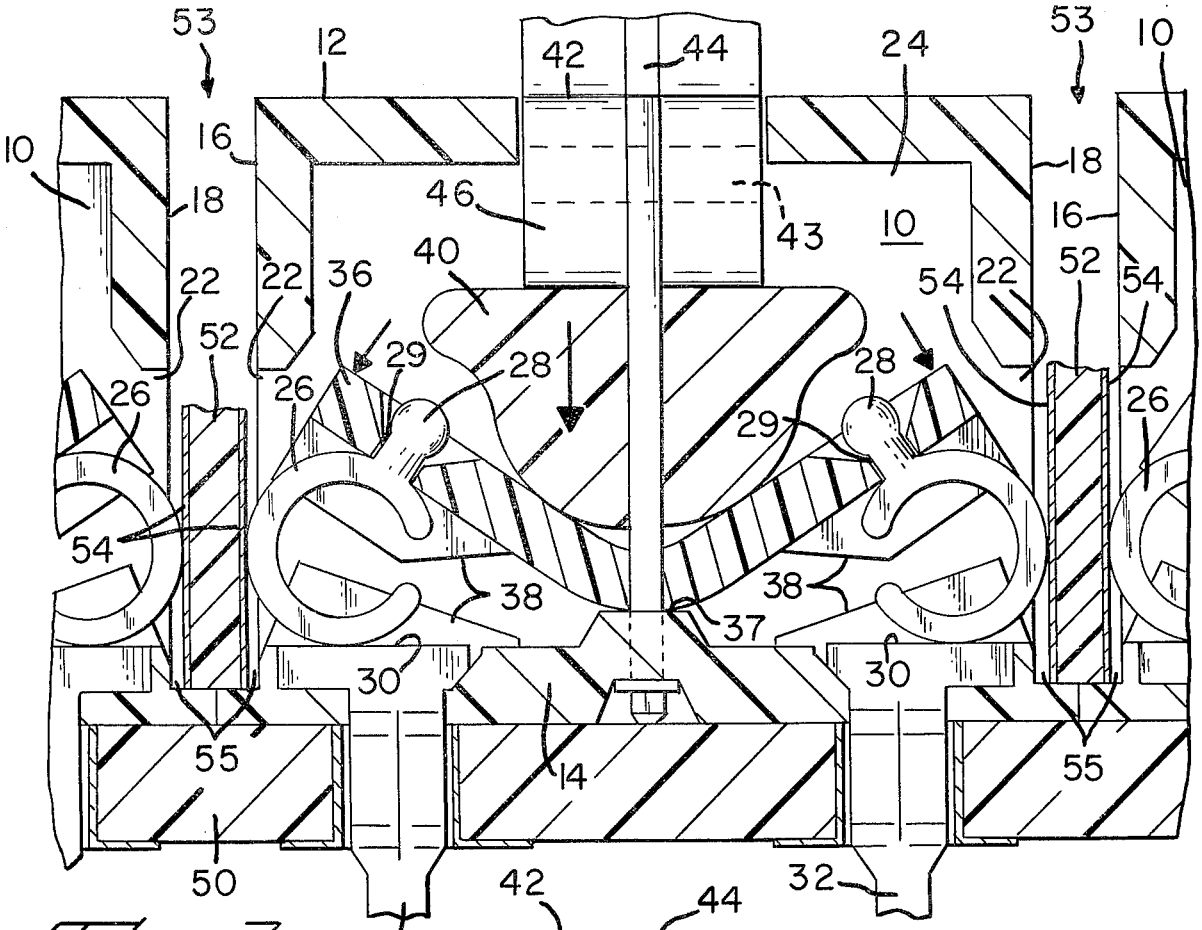
FIG. 2 is a side sectional view of the connector assembly shown in FIG. 1 with additional connector assemblies adjacent thereto, in the closed contact position.
Figure 3:
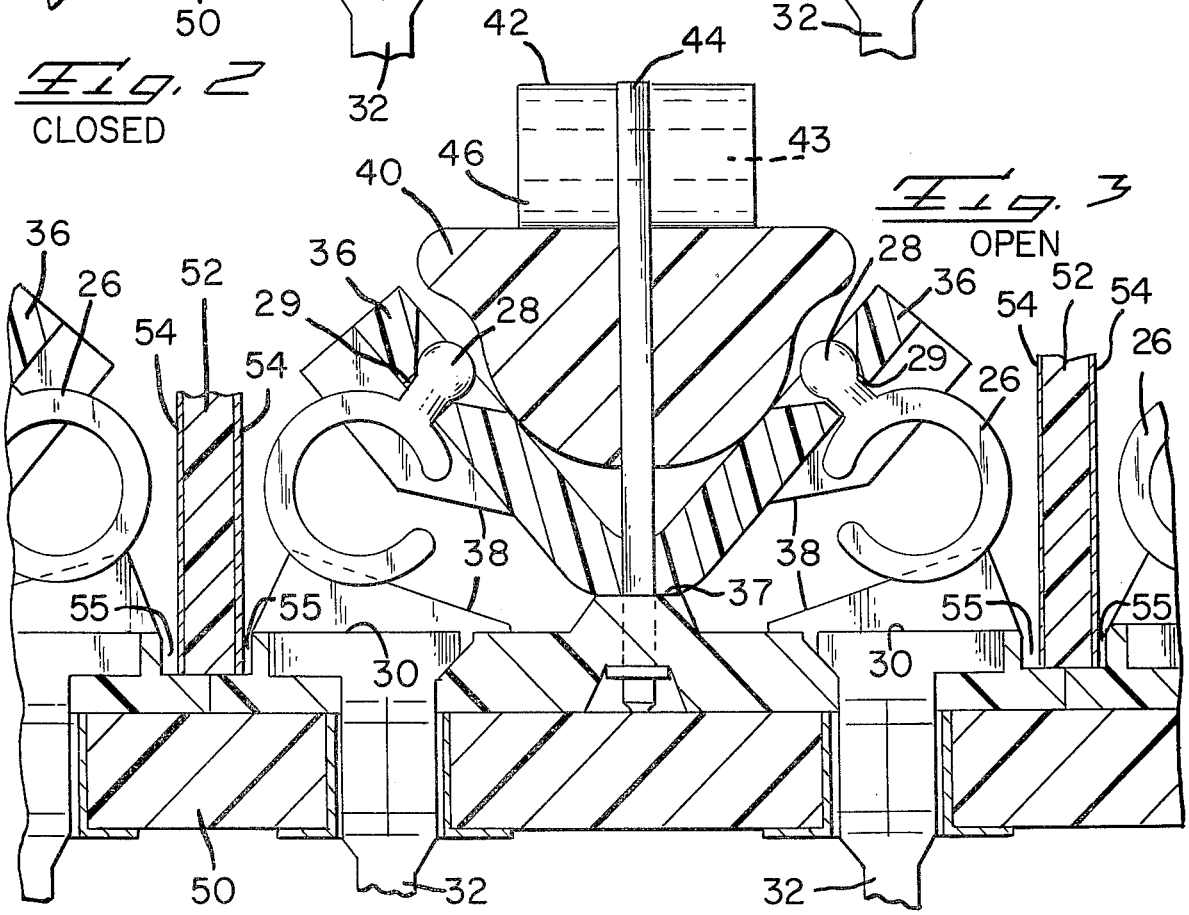
FIG. 3 is another side sectional view similar to that in FIG. 2 with the housing removed and the contacts in an open position.

The contacts 26 are held by the contact holder 36 at the contact pivot point 29 (shown more clearly in FIGS. 2 and 3). The contacts 26 as mentioned earlier come in contact with an electrical post 30 which is comprised of an electrical post 32 having a split portion 34 thereby fixedly securing the electrical post 32 to a mother board 50. A cam 40 is disposed between the "U" portion of the contact holder 36 to facilitate flexing of the contact holder 36. Attached to the cam 40 is a cam actuator mechanism 42 which is comprised of the cam actuator retaining bracket 44, a cam actuator bracket 46, and a cam actuator handle 48.

The cam actuator mechanism 42 is utilized by lateral movement (parallel to the connector assembly 10) of the cam actuator handle 48. Since a retaining pin 43 is offset from the handle 48, the cam 40 is urged downward (shown more clearly in FIGS. 2 and 3).

Referring now to FIG. 2 there is shown a connector assembly 10 of the present invention with the contacts 26 in the closed position. As mentioned earlier, movement of the cam actuator handle 48 (not shown) causes downward movement of the cam 40. This downward movement of the cam 40 causes the contact holder 36 which impinges upon the contact holder pivot point 37 to resiliently flex and thereby cause the contacts 26 to be forced downwardly and outwardly so as to come in contact with the electrical post contact 30 and the daughter board contact strips 54 contained on the daughter board 52. The contacts 26 also resiliently flex thereby providing a structurally and electrically secure connection between the electrical post contact 30 and the daughter board contact strips 54. Here it can be more readily seen how the contacts 26 pivot about the contact pivot point 29. It can also be seen that the electrical path established by the contacts 26 between the post contact 30 and the contact strips 54 is extremely short. Since this essentially arcuate distance is so brief any possible inductive, capacitive or propagation delay times due to the length of the contact 26 are kept to an absolute minimum. Additionally, in its movement the contacts 26 perform a wiping action against both the post contact 30 and the contact strips 54. The ribs 38 as mentioned previously, provide structural integrity to the contact holder 36 as well as provide an electrical and physical barrier between adjacent contacts 26. The cam actuator retaining bracket 44 is fixedly secured to the bottom wall 14 and is also used to prevent lateral movement of the contact holder 36. The cam 40 is comprised of an electrically insulative material such as, for example, plastic. Similarly, the contact holder 36 is also of an insulative material. Additionally, in side-by-side relationship are additional connector assemblies 10 which are facing each other thereby defining opposite sides of the mother board receiving channel 53. Similarly, the adjacent connector assemblies 10, are attached to the mother board 50. This allows the insertion and withdrawal of the daughter board 52 into and away from the daughter board receiving channel 53. Once the daughter board 52 is inserted into the channel 53 it is placed to rest on the daughter board retaining ledge 55.

Referring now to FIG. 3 there is shown the connector assembly 10 of the present invention in the open position with the housing 12 (FIGS. 1 and 2) removed. Here it can be readily seen that in the open position the contacts 26 are in an upward and inward position so as not to touch the electrical post contact 30 or the daughter board contact strips 54 thereby allowing the insertion or withdrawal of the daughter board 52.

Figure 4:
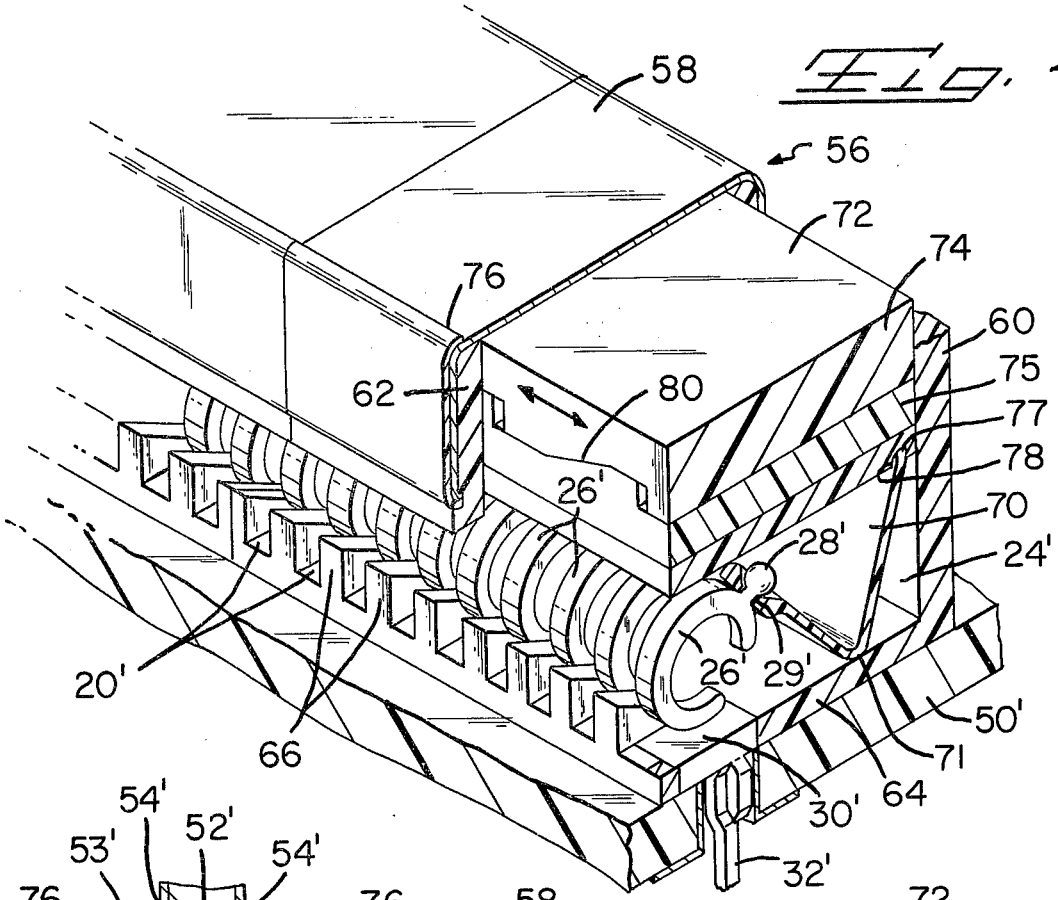
FIG. 4 is an enlarged perspective view of a multiple connector assembly and which is an alternate embodiment of the present invention.

Referring now to FIG. 4, an alternate embodiment of the present invention is shown. It is to be remembered that components similar in structural operation to previously described components will be identified by the previously assigned numeral with the addition of a prime (').

Here, a modified housing 58 has side and bottom walls 60, 62 and 64, respectively. The contacts 26' are disposed in the modified connector assembly 56 inside the passageway 24' (each contact 26' being disposed in a contact compartment 20'). The contact compartments 20' are separated by partial compartment barriers 66. The contacts 26' each have a test point 28' which is secured to the unitary contact holder 70 by the contact pivot point 29'. The modified connector assembly 56 resides with a mother board 50' which has electrical posts 32' inserted therethrough so as to make electrical contact at the electrical post contact 30' with the contacts 26'. The unitary contact holder 70 pivots at the unitary contact holder pivot point 71. The unitary contact holder 70 has one end inserted into an intermediate plate 77 at the contact retaining slot 78 thereby preventing movement of one end of the unitary contact holder 70. Disposed on top of the intermediate plate 77 is the actuating cam member 72 which is comprised of an upper linear cam member 74 and the lower linear cam member 75. The upper and the lower linear cam member 74, 75 each have linear cam serrations 80 so as to provide proper vertical deflection of the unitary contact holder 70 and therefore the proper movement of contacts 26'. Insulation 76 is disposed on the contact side of the modified connector assembly 56 thereby providing electrical isolation from the daughter board 52' (FIG. 5).

Figure 5:
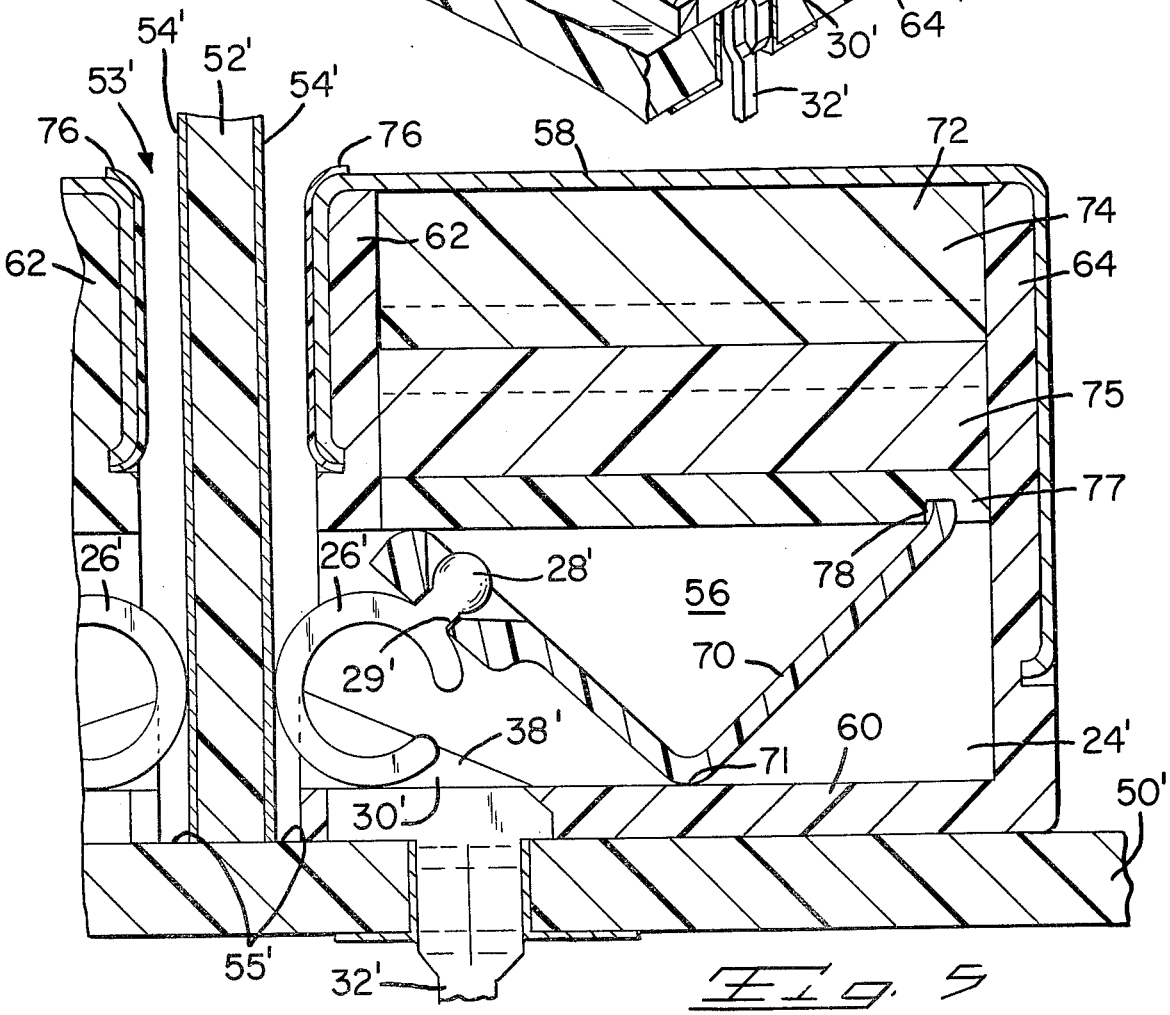
FIG. 5 is a side sectional view of the alternate embodiment of the present invention as shown in FIG. 4 with the contacts in the closed position.

Referring now to FIG. 5 a side cross sectional view of the modified connector assembly 56 is shown with the contacts 26' in the closed position. Here, two modified connector assemblies 56 are disposed adjacent to each other so as to allow a daughter board 52' to be inserted into the daughter board receiving channel 53' and thereby rest on the daughter board retaining ledge 55'. Insulation 76 is disposed on the sidewalls 62 thereby isolating the daughter board contacts 54' from possibly coming in contact with any non-insulated area. The contacts 26' as in FIGS. 1, 2, and 3, contact the daughter board contact strips 54' and the electrical post contacts 30' and also cause a wiping action. The unitary contact holder 70 having a contact point pivot 29' to accommodate the contact 26' and the test point 28', pivots about the unified contact holder pivot point 71. One end of the unitary contact holder 70 is disposed in the intermediate plates 77 in a contact retaining slot 78. This, therefore, allows the upper linear cam member 74, when moved laterally (as shown in FIG. 4) to cause the actuating cam members 72 to resiliently flex the unitary contact holder 70 thereby causing the contact 26' to come in contact with the electrical post contact 30' and the daughter board contact strips 54'. The contacts 26' in a fashion such as that in FIGS. 1, 2, and 3 experience some resilient flexing so as to ensure proper electrical and mechanical contact. Again, the electrical conductive path established by the contacts 26' are extremely short thereby minimizing any possible inductive, capacitive, or propagation delay problems associated therewith.

Figure 6:
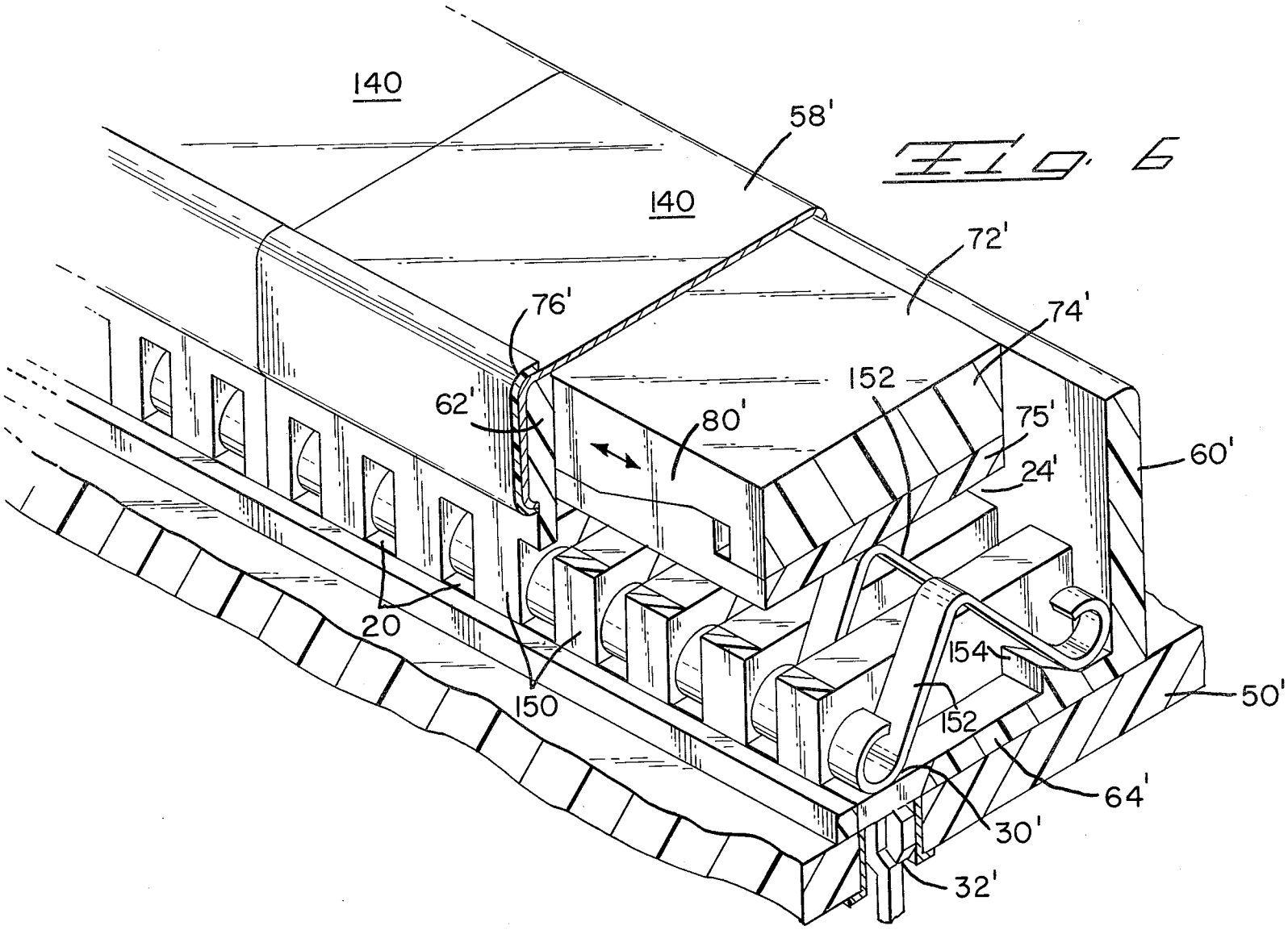
FIG. 6 is an enlarged perspective view of a multiple connector assembly and which is another alternate embodiment of the present invention.

Referring now to FIG. 6, another alternate embodiment of the present invention is shown. It is again to be remembered that components similar in structural operation to previously described components will be identified by the previously assigned numeral with the addition of the prime (').

Here, a connector assembly 140 is comprised of a housing 58' having side and bottom walls 60', 62' and 64' respectively. The contacts 152 are disposed in the housing 58' inside the passageway 24'. The contacts 152 are separated by housing ribs 150. The housing ribs 150 provide electrical isolation between each of the contacts 152 as well as preventing undesired distortion or twisting of the contacts 152. Again, the assembly 140 resides on a mother board 50' which has electrical posts 32' inserted therethrough which are in electrical contact at the electrical post contact 30' with a portion of the contacts 152. The contacts 152 are positioned inside the housing 50' by a contact positioner 154 which prevents movement or migration of the contact 152 in the contact compartments 20'. Disposed on top of the contacts 152 is the actuating cam members shown generally at 72' which is comprised of an upper linear cam member 74' and a lower linear cam member 75'. The upper and lower linear cam members 74', 75' each having linear cam serrations 80' so as to provide proper vertical deflection of the lower linear cam member 75' and therefore proper movement of contacts 152. Insulation 76' is again disposed on the contact side of the connector assembly 140 thereby providing electrical isolation from the daughter board 52' (shown in FIGS. 7 and 8).

Figure 7:
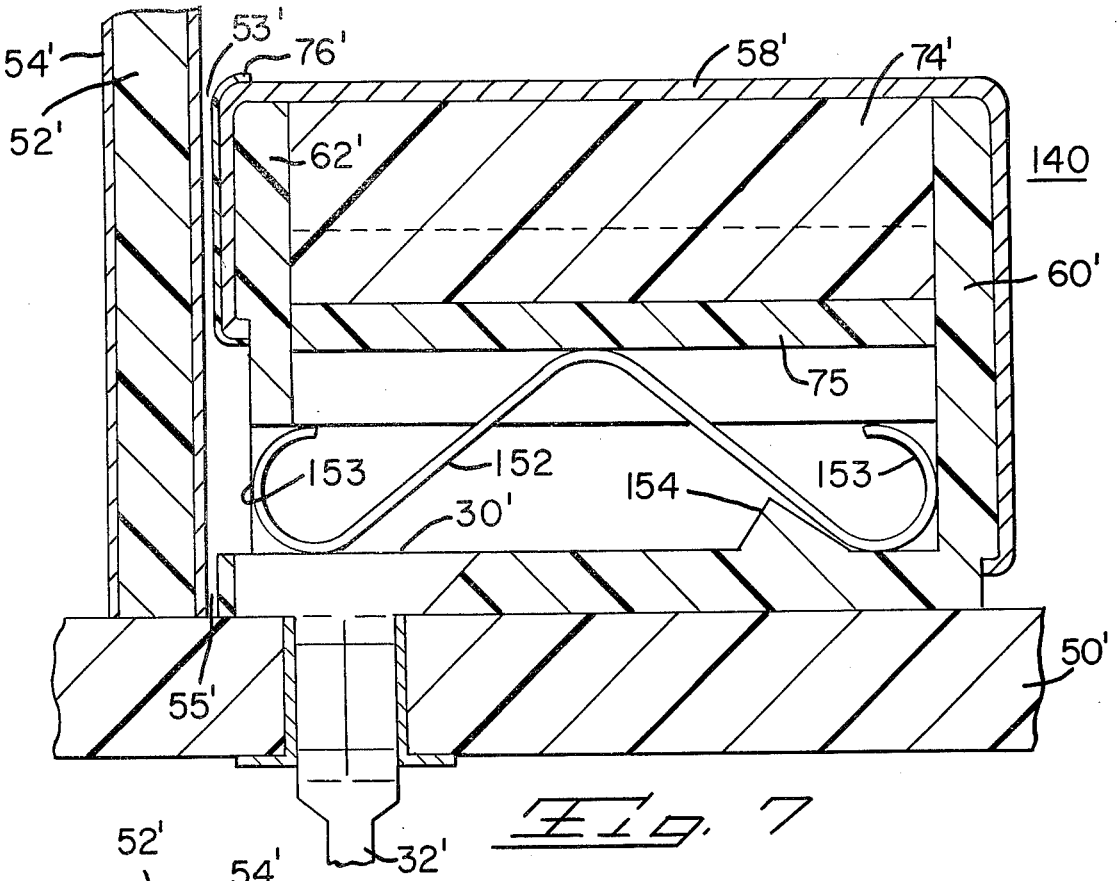
FIG. 7 is a side sectional view of the connector assembly shown in FIG. 6 in the open contact position.

Referring now to FIG. 7 a side cross-sectional view of the connector assembly 140 is shown with the contacts 152 in the open position. Here it can be seen that the daughter board 52' having a conductive strip thereon 54' is disposed in a daughter board receiving channel 53' at the daughter board retaining ledge 55'. Here it can also be seen that the contact mating surface 153 of the contact 152 while contacting the electrical post contact 30' is not in electrical or physical contact with the daughter board contact strips 54'. This allows the daughter board 52' to be inserted or extracted with zero force necessary.

Figure 8:
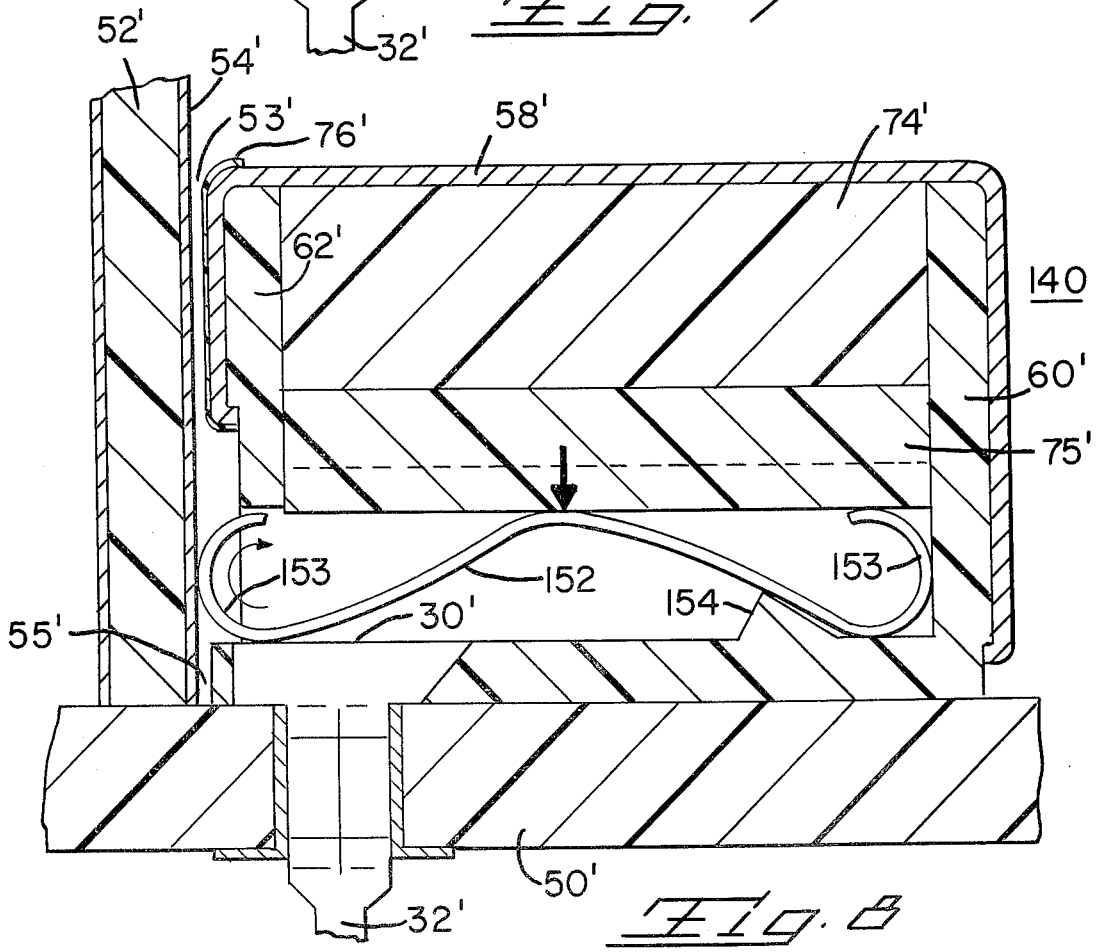
FIG. 8 is a side sectional view of the alternate embodiment of the present invention as shown in FIG. 7 with the contacts in the closed position.

Referring now to FIG. 8 a side cross-sectional view of the connector assembly 140 similar to that shown in FIG. 7 with the exception that the contacts 152 as shown are closed. Here as in the manner illustrated for FIG. 4, lateral movement of the upper linear cam member 74' will cause the lower linear cam member 74' to move vertically downward. This will in turn cause a deflection of the contact 152 such that the contact mating surfaces 153 are urged outward. More particularly, the contact mating surface 153 which is adjacent to the daughter board 52' will move across the electrical post contact 30' and into contact with the daughter board contact strips 54'. This movement of the contact mating surface 153 is of a contact wiping nature thereby providing a good electrical circuit path between the daughter board contact strip 54' and the electrical post contact 30' which is extremely short thereby minimizing any possible inductive, capacitive, or propagation delay problems associated therewith. Due to the symmetry of the contact 152, it is readily obvious that the contact may be removed and turned around if it should be determined that one of the contact mating surfaces 153 is defective. It is to be understood, however, that the contact 152 may be constructed with only one contact mating surface 153 and a contact positioner 154 which fixedly secures the contact 152 in the assembly 140. Further, the contact mating surface 153 may be an independent component separate from the contact 152 proper which is fixedly secured to the contact 152 in a manner such as crimping, soldering, or the use of electrically conductive glues.

It is to be understood that many variations of the present invention may be utilized without departing from the spirit and scope of the present invention. For example, circuit boards may include any board, card, or substrate in which electrical circuit conductors are secured by printing, plating, or other suitable process. Additionally, the connector assemblies 10, 56 may also include a single assembly for which the conductors of a circuit board are solely on one surface of the board. Further, the contacts of FIGS. 1 through 5 may be shaped solely by cutting a flat sheet of material with no bending or forming of the material required. Additionally, the contacts may be of any suitable material such as, for example, plastic with a conductive coating on all or a portion thereof of the contact or the contact holder may be of a conductive material with the contact holder being electrically insulative at the pivot point between the contact and the holder, or the test point could be eliminated or have a different shape. Also, the intermediate plate 77 and/or the lower linear cam members could be one piece or any other camming schemes which would cause suitable movement of the contact and/or contact holders may be utilized. Also, materials other than plastic may be utilized for the housing as well as different compartment barrier spacings or dimensions which may accommodate thermal expansion anticipated for a particular usage. Further, different contact posts arrangements suitable for intersection with a mother board may be utilized.

Therefore, in addition to the above enumerated advantages, the disclosed invention produces a circuit board edge connector which is compact, providing modular growth capabilities, accommodating thermal expansion as well as various circuit board arrangement constraints and very short contact length.

I claim:

1. A circuit board edge connector, comprising:

an insulative housing;

conductive post projecting from said housing;

circuit board having circuit conductors contained thereon, said circuit board being received by said housing;

spring contact means contained in said housing and being electrically conductive and adapted for providing electrical communication between corresponding circuit conductors on said circuit board and said conductive posts, said spring contact means pivotally attached to a contact holder means;

contact holder means contained in said housing and adapted for resilient flexure for pivotally moving said spring contact means into or out of electrical communication with said conductive posts and said circuit conductors; and cam means adjacent to said contact holder means for resiliently flexing said contact holder means.

2. A device according to claim 1 wherein said housing has a series of compartments, each compartment having a conductive post and further having removably assembled therein said spring contact means and further having said contact holder means and said cam means perpendicularly intersect the compartments, thereby allowing said cam means to impinge against said contact holder means so that upon movement of the cam means against said contact holder means, said spring contact means is caused to pivot toward and engage corresponding circuit conductors and conductive posts.

3. A circuit board edge connector, comprising:

an insulative housing having a series of compartments;

a conductive post disposed in and projecting from each compartment in each housing;

circuit board having circuit conductors contained thereon, said circuit board being received by said housing;

spring contact means disposed in each compartment in said housing and being electrically conductive and adapted for providing electrical communication between corresponding circuit conductors on said circuit board and said conductive posts, said spring contact means pivotally attached to a contact holder means;

said contact holder means contained in said housing perpendicular to said compartments and being adapted for resilient flexure for pivotally moving said spring contact means into or out of electrical communication with said conductive posts and said circuit conductors; and cam means adjacent said contact holder means for resiliently flexing said contact holder mean so that upon movement of the cam means against said contact holder means, said spring contact means is caused to pivot toward and engage corresponding circuit conductors and conductive posts.

4. A device according to claim 1 or 2 or 3 wherein said contact holder means is comprised of an electrically insulative material.

5. A device according to claim 1 or 2 or 3 wherein said housing is disposed on a second circuit board.

6. A device according to claim 1 or 2 or 3 wherein a plurality of housing sections are disposed adjacent to each other.

7. A device according to claim 1 or 2 or 3 wherein said spring contact means has a form obtained by having been cut from and lifted out from a flat sheet of metal.

8. A device according to claim 1 wherein spring contact means is pivotally attached to said contact holder means by way of a socket thereby interlocking said spring contact means and said contact holder means.

9. A device according to claim 8 or 3 where said contact holder means is comprised of an electrically conductive material, having an electrically insulative material disposed on said contact holder means at a point wherein said spring contact means impinges upon said contact holder means.

10. A device according to claim 1 wherein said spring contact means is comprised of an electrically insulative material having a conductive material disposed thereon.

11. A device according to claim 1 wherein said spring contact means is resiliently flexive.

12. A circuit board edge connector, comprising:

an insulative housing;

conductive posts projecting from said housing;

circuit board having circuit conductors contained thereon, said circuit board being receivably received by said housing;

spring contact means contained in said housing and having a generally inverted V-shape having a generally arcuate portion at one end thereof, said arcuate portion being electrically conductive and in slidable electrical communication with said circuit conductors and said conductive posts, said spring contact means being resiliently flexive so as to move said arcuate portion into or out of electrical communication with said conductive posts and said circuit conductors; and cam means adjacent to said spring contact means for resiliently flexing said spring contact means.

13. A device according to claim 12 wherein said housing has a series of compartments, each compartment having a conductive post and having removably assembled therein said spring contact means and further having said cam means perpendicularly intersecting the compartments, thereby allowing said cam means to impinge against said contact means so that upon movement of said cam means said contact means is caused to move thereby causing said arcuate portion of said spring contact to move toward and engage corresponding circuit conductors.

14. A device according to claim 12 or 13 wherein said spring contact means is comprised of an electrically insulative material having an electrically conductive material disposed thereon.

15. A device according to claim 12 or 13 wherein said housing is disposed on a second circuit board.

16. A device according to claim 12 or 13 wherein a plurality of housing sections are disposed adjacent to each other.

17. A device according to claim 12 or 13 wherein said spring contact means has a form obtained by having been cut from a flat sheet of metal and bent into the appropriate form.

18. A circuit board edge connector, comprising:

an insulative housing;

conductive posts projecting from said housing;

circuit board having circuit conductors contained thereon, said circuit board being received by said housing;

spring contact means contained in said housing and being electrically conductive and adapted for providing electrical communication between corresponding circuit conductors on said circuit board and said conductive posts, said spring contact means pivotally attached to a contact holder means by way of a socket thereby interlocking said spring contact means and the contact holder means;

said contact holder means contained in said housing and adapted for resilient flexure for pivotally moving said spring contact means into or out of electrical communication with said conductive posts and said circuit conductors; and cam means adjacent to said contact holder means for resiliently flexing said contact holder means.

* * * * *